United States Patent [19]

Roos et al.

[11] Patent Number: 4,494,315

[45] Date of Patent: Jan. 22, 1985

[54] CONTINUOUS DRIER FOR PLYWOOD SHEETS

[75] Inventors: Friedrich Roos, Hauneck; Friedrich Bahner, Rotenburg, both of Fed. Rep. of Germany

[73] Assignee: Babcock-BSH Aktiengesellschaft Vormals Büttner-Schilde-Haas AG, Krefeld, Fed. Rep. of Germany

[21] Appl. No.: 376,832

[22] Filed: May 10, 1982

[30] Foreign Application Priority Data

May 26, 1981 [DE] Fed. Rep. of Germany ..... 3120917

[51] Int. Cl.[3] ..... F26B 21/10

[52] U.S. Cl. ..... 34/48; 34/52; 34/54; 34/216

[58] Field of Search ..... 53/504; 34/46, 48, 52, 34/44, 56, 215, 216, 217, 54

[56] References Cited

U.S. PATENT DOCUMENTS

| | | | |
|---|---|---|---|
| 3,350,789 | 11/1967 | Davies | 34/48 |
| 3,783,527 | 1/1974 | Driscoll et al. | 34/44 |
| 4,145,818 | 3/1979 | Kulling | 34/10 |
| 4,199,871 | 4/1980 | Ward et al. | 34/48 |

FOREIGN PATENT DOCUMENTS

| | | |
|---|---|---|
| 1528302 | 4/1970 | Fed. Rep. of Germany . |
| 2721965 | 11/1978 | Fed. Rep. of Germany . |

*Primary Examiner*—Larry I. Schwartz

*Attorney, Agent, or Firm*—Michael J. Striker

[57] ABSTRACT

A continuous drier for plywood sheets is provided at its inlet end with a sensing device measuring the width and the spacing of the plywood sheets entering the drier. The values measured by the sensing device are transmitted to a control device, which by means of a calculator regulates the speed of a conveyor transporting the plywood sheets through consecutive sections of the drier in such a manner that the plywood sheets follow each other closely on the conveyor without overlapping. Each of the sections is provided with a heater and a ventilator which blows air over the heater, and the hot air is directed by installations onto the plywood sheets. In order to compensate the effect of the varying speed of the conveyor with respect to the drying of the plywood sheets, the control device preferably controls also the volume of the streams of hot air by varying the speed of the ventilators. This will result in a considerable saving of the driving energy.

6 Claims, 5 Drawing Figures

CONTINUOUS DRIER FOR PLYWOOD SHEETS

BACKGROUND OF THE INVENTION

The present invention relates to a continuous drier for plywood sheets in which the drier comprises an elongated housing divided into a plurality of consecutive sections in each of which a heater is arranged as well as a ventilator or blower for blowing air over the heater and installations for guiding the hot air thus produced in transverse direction over the plywood sheets which are transported by a conveyor with variable speed through the drier, and which include a device for automatically controlling the speed of the conveyor.

In modern installations, the drier is arranged directly downstream of a machine which cuts the plywood sheet from a wood block, and the drier therefore must receive the plywood sheets in the sequence in which they are produced from the cutting machine. Since the cutting sequence of the cutting machine has to be continuously adapted to the quality of the wood to be cut, and since the width of the individual plywood sheets varies greatly in accordance with the thickness of the wood block to be cut, the covering of the conveyor with plywood sheets is irregular. In order to avoid overlapping of the plywood sheets on the conveyor, the latter is practically driven with the maximum speed determined by the maximum number of cutting strokes of the cutting machine and the maximum width of the cut plywood sheets. The density at which the conveyor is covered by the plywood sheets will vary in practice continuously between zero and about 70%, and the average of covering of the conveyor by plywood sheets is usually about 50–60%. While the possibility exists to manually regulate the speed of the conveyor, this is usually not done since the operating personnel are usually fully occupied with other tasks. Furthermore, by manually regulating the speed of the conveyor it is at best possible to carry out rough corrections only.

In correspondence with the varying covering of the conveyor by plywood sheets, the amount of water to be evaporated from the latter varies also considerably. This in connection with the different initial humidities of the individual plywood sheets therefore requires a continuous adaptation of the drying requirements.

German Offenlegungsschrift No. 27 21 965 discloses a method which takes these requirements into account. According to this method, the local heat consumption and the humidity of the air are measured along the conveyor through the drier and the optimal drying conditions are calculated by means of a calculator and automatically adjusted. The adjustment may for instance be carried out by varying the speed of the conveyor transporting the plywood sheets through the elongated drier. The varying density at which the conveyor is covered by the plywood wood sheets is thereby accepted, and while the change of the speed of the conveyor indirectly influences also the density at which the conveyor is covered by the plywood sheets, a dense covering of the conveyor by plywood sheets is thereby neither aimed at nor accomplished.

The varying density at which the conveyor is covered by the plywood sheets has, however, a series of disadvantages. Since it is necessary to operate the conveyor continuously at high speed, the wear on the conveyor is considerable. If considerable distances exist between successive plywood sheets on the conveyor, the edges of the plywood sheets are excessively dried, which is detrimental to the quality thereof. Due to the high speed of the conveyor, the time at which the plywood sheets remain in the drier is relatively short. To compensate for this high drying temperatures are necessary, which entail a reduction of the quality of the plywood sheets, or drying air streams of great volume are required, which entails a high energy consumption for the drive motors of the ventilators.

German Offenlegungsschrift No. 15 28 302 discloses a conveyor for transporting plywood sheets through a drier in which the speed of the conveyor is, in accordance with the width of successive plywood sheets and the operating speed of the cutting machine, controlled in such a manner that the plywood sheets follow each other on the conveyor in close succession. Since in this case only the speed of the conveyor is controlled, the necessary conditions for properly drying the plywood sheets are not met. Evidently, a change of the speed at which the plywood sheets are transported to the drier will also change the time during which the plywood sheets remain in the drier, and therewith the drying conditions.

SUMMARY OF THE INVENTION

It is an object of the present invention to provide for a continuous drier which is adapted to be arranged in line with a cutting machine producing plywood sheets of varying widths and varying succession, and in which the drier is constructed in such a manner to produce independent of variations of the width and succession of sheets of plywood produced by the cutting machine an assured dense covering of the conveyor transporting the plywood sheets through the drier, while maintaining optimal drying conditions during such transport.

With these and other objects in view, which will become apparent as the description proceeds, the continuous drier for plywood sheets according to the present invention adapted to be arranged in line with a cutting machine producing plywood sheets of varying widths and in a varying succession, comprises an elongated housing having an inlet end and being divided into a plurality of consecutive sections; conveyor means for transporting the plywood sheets from the inlet end through the consecutive sections of the housing; drive means for driving the conveyor means with a variable speed; heating means cooperating with a ventilator for blowing air over the heating means and means for directing the thus produced hot air onto the plywood sheets and permitting transverse passage of the spent air over the plywood sheets in each of the sections; sensing means at the inlet end of the housing for measuring the width and the spacing of the plywood sheets entering the housing; and control means in circuit with the sensing means for regulating the speed of the conveyor means to assure a close succession of the plywood sheets on the conveyor means and for regulating the volume of the streams of hot air and/or the temperature of the latter in dependence upon the speed of the conveyor means.

In this arrangement, any occurring variation of the time during which the plywood sheets remain in the drier is compensated by corresponding change of the volume of the air stream and/or the temperature of the revolving drying air.

Preferably, the volume of revolving drying air streams is varied in dependence on the speed of the conveyor by driving the ventilators with a variable-speed motor, and by having the control means vary the speed of each motor in dependence on the speed of the conveyor. By changing the rotational speed of the ventilators, it is possible to adapt the drying conditions practically without any delay to even large variations of the conveyor speed. This arrangement will at the same time provide considerable savings of the drive energy.

The rotational speed of the drive motors for the ventilators may be stepwise regulatable, for instance with pole-changeable motors, and in this case the control means will adjust, depending on the regulated speed of the conveyor means, some of the drive motors to operate at high speed and the remaining drive motors to operate at low speed.

On the other hand, the drive motors for the ventilators may be constructed as continuously variable-speed motors, which permits a stepless adaptation of the speed of the drive motors to the speed of the conveyor.

The drier may also include a bypass in each of the sections for passing part of the air produced by the respective ventilator past the respective heating means and a flap controlled by the control means for opening the bypass to a varying degree in accordance with the regulated speed of the conveyor means to thereby change the temperature of the air impinging on the plywood sheets. This modification can be produced at especially low cost, whereby however drive energy is not saved.

The aforementioned sensing means preferably comprise a plurality of transversely spaced sensing elements for measuring the width of the plywood sheets, so that also by irregularly formed plywood sheets an overlapping of the same on the conveyor means may be avoided.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
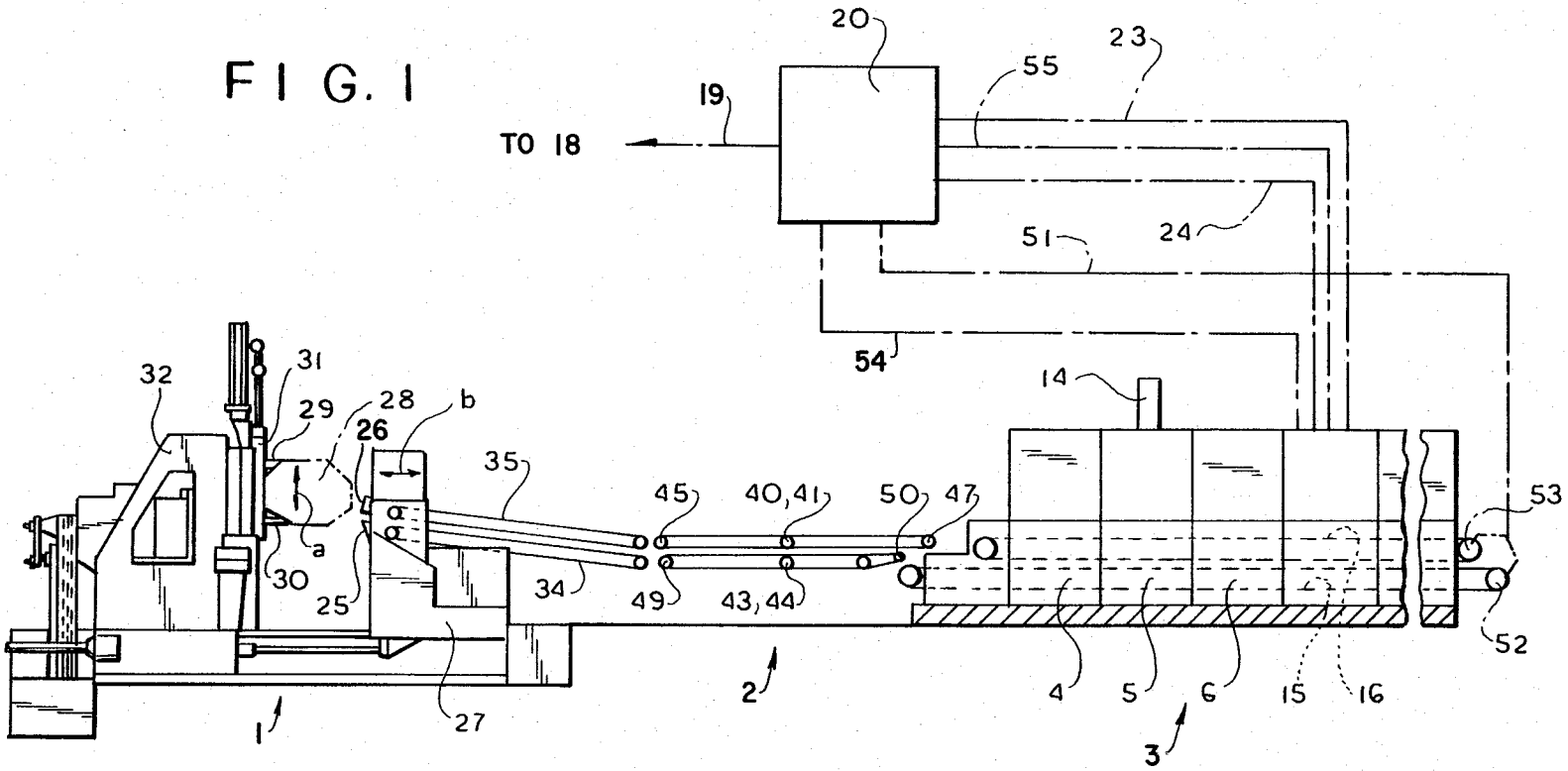
FIG. 1 schematically illustrates in a side view a continuous drier according to the present invention in line with a plywood sheet cutting machine and intermediate conveyor means for transporting the plywood sheets cut by the cutting machine to the conveyor extending through the drier.

FIG. 1 schematically illustrates a plywood sheet cutting machine 1, an intermediate transporting arrangement 2 transporting the plywood sheets produced by the machine 1 onto a conveyor of a continuous drier 3 according to the present invention. The cutting machine 1 schematically illustrated in the drawing may comprise a stationary machine frame 32 on which a slide 31 is arranged holding a wood block 28 by means of a pair of claws 29 and 30 for reciprocation with the slide 31 in the direction of the arrow a. A tool slide 27 is arranged on the side of the wood block 28 opposite from the side held by the claws to the reciprocating slide 31, and the tool slide 27 carries a cutting knife 25 and, upwardly spaced from the latter, a pressure beam 26. The tool slide 27 is mounted on rails movable in the direction of the arrow b toward and away from the wood block 28. In order to cut a plywood sheet from the wood block 28, the tool slide 27 is moved toward the wood block so that the knife 25 will, during downward movement of the block 28, enter the latter for a depth of a few tenths of a millimeter, to thereby cut the plywood sheet from the wood block. When the block 28 reaches its lowermost position and a plywood sheet is cut therefrom, the tool slide 27 is moved slightly away from the block, so that the latter may be freely moved again in upward direction, whereafter the aforedescribed cycle of the operation is repeated.

Such cutting machines as schematically illustrated in FIG. 1 of the drawing are well known in the art, and a similar cutting machine is for instance disclosed in U.S. Pat. No. 2,676,627. However, it is emphasized that various different cutting machines known in the art may be used in combination with the continuous drier according to the present invention.

The cut plywood sheet slides from the knife 27 directly onto the conveyor band 34 over which a cover band 35 is arranged to hold the plywood sheet properly on the conveyor band 34. The conveyor band 34 and the cover band 35 are moved in the manner not illustrated in the drawing at the same speed at which the block 28 is moved in downward direction during the cutting. The speed of the bands 34, 35 may for instance be 120 meters per minute. During the upward movement of the block 28, and during part of the downward movement thereof during which the cutting knife does not engage the block 28, the bands 34 and 35 are continuously driven, so that successive cut plywood sheets are arranged between the bands 34 and 35 at considerable distances from each other. The plywood sheets transported by the bands 34, 35 are transmitted by an intermediate conveyor 2, to be described in detail further below, onto the conveyor extending in longitudinal direction through the drier 3 and comprising an endless conveyor band 15 and an endless cover band 16 above the conveyor band, so that the plywood sheets may be transported between the upper run of the conveyor band 15 and the lower run of the cover band 16. The conveyor band 15 and the cover band 16 are driven at synchronous speed, which is variable in a manner to be described below.

Figure 2:
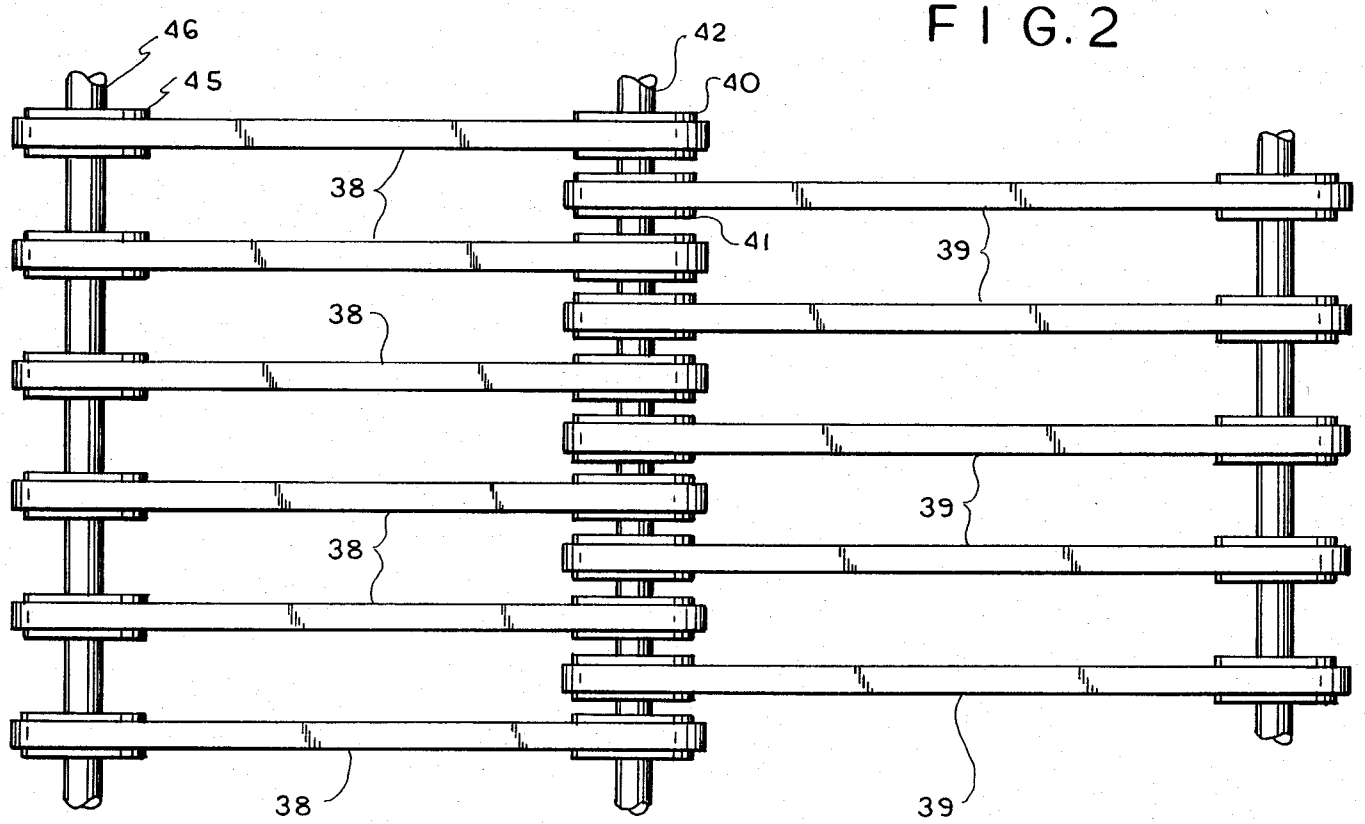
FIG. 2 is a top view of a part of the intermediate conveyor.

In order to reduce the distances between successive plywood sheets on the conveyor band 15 as much as possible, the conveyor band 15 and the cover band 16 have to be moved in longitudinal direction at a speed considerably smaller than the speed at which the bands 34 and 35 are driven. The intermediate conveyor means 2 serves to stepwise reduce the transporting speed of the plywood sheets. If the plywood sheets would be directly transmitted from the bands 34, 35 to the bands 15, 16, then the plywood sheets would be, due to the high speed difference, upset, bent and buckled at the transition point. The intermediate conveyor means 2 comprises two conveyor band systems 36 and 37 with corresponding cover band systems 38 and 39 arranged thereabove, and the two systems are arranged in a staggered manner as clearly shown in FIG. 2. The pulleys 40 for the cover bands 38, as well as the pulleys 41 for the cover bands 49, are freely turnably arranged on the intermediate shaft 42, and the pulleys 43, 44 for the conveyor bands 36, 37 are likewise freely rotatable on a shaft located beneath the shaft 42 and not shown in FIG. 2. The left pulleys 45 for the cover bands 38 are fixedly mounted on a shaft 46 driven by means not shown in the drawing, and the left pulleys 49 for the conveyor bands 36 are likewise fixed to a shaft, not shown in FIG. 2, located beneath the shaft 46 and driven at the same speed as the latter, so that the conveyor band 36 and the corresponding cover band 38 are driven with synchronous speed, which may for instance be 80 meters per minute. The right pulleys 47 of the conveyor band 39 are mounted on a shaft 48 for rotation therewith, which is driven by means not shown in the drawing, and the right pulleys 50 of the conveyor band 37 are likewise mounted on a shaft, not shown in FIG. 2, located beneath the shaft 48 and driven at synchronous speed with the latter, so that the cover bands 39 and the conveyor bands 37 are normally for instance driven with a speed of 50 meters per second. The aforementioned speeds may be varied as will be described below.

An intermediate transport arrangement for stepwise reduction of the speed of plywood sheets is known in the art and for instance disclosed in German Offenlegungsschrift No. 15 28 302 mentioned above.

Figure 5:
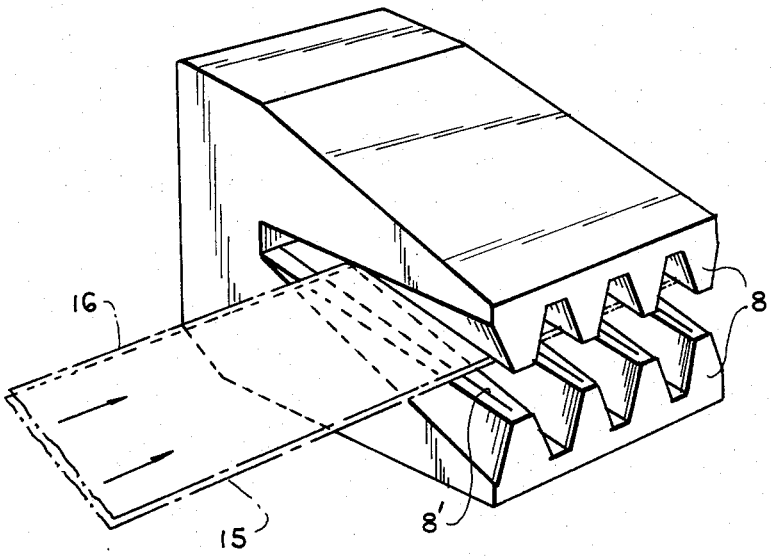
FIG. 5 is a partial perspective view illustrating the installation in each section of the drier for directing the drying air onto the plywood sheets as they are transported by the conveyor through the drier.
Figure 4:
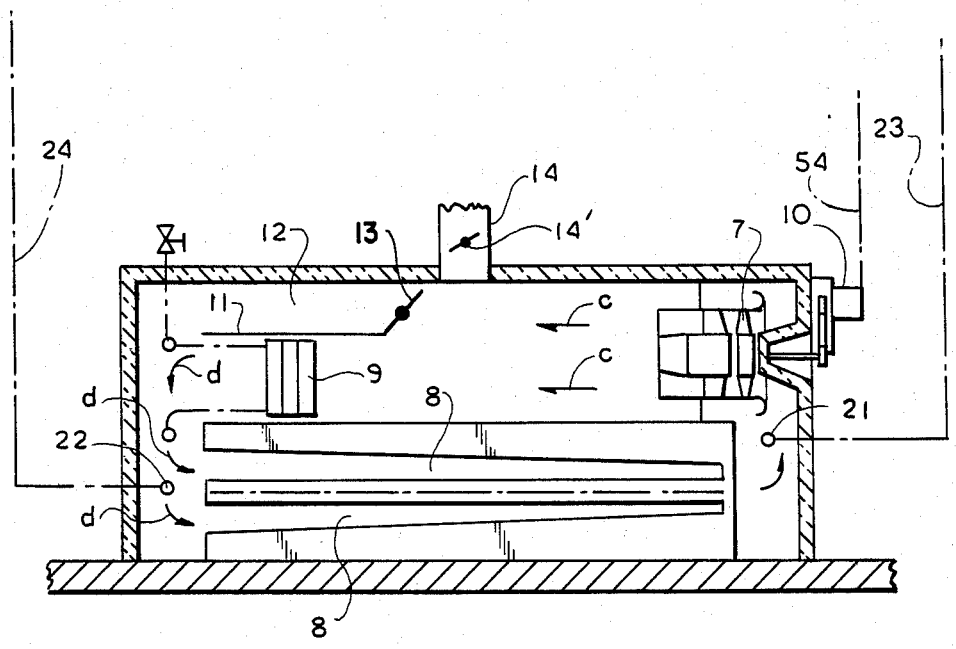
FIG. 4 is a transverse section through one of the consecutive sections of the drier.

The drier 3 located downstream of the intermediate transporting arrangement 2 is divided by a plurality of transverse walls into consecutive sections 4, 5, 6, etc. Conveyor means comprising a lower endless conveyor band 15 and an upper endless cover band 16 extend in longitudinal direction through the whole drier 3 to transport the plywood sheet furnished by the intermediate conveyor means 2 through the whole drier 3. Each of the drying sections is provided, as best shown in FIG. 4, with a ventilator 7 which blows air in the direction of the arrows c over heating means 9, likewise arranged in each of the sections, from which the air is passed in the direction of the arrows d through nozzle means 8, as best shown in FIG. 5, from which the hot air passes through elongated slots 8' onto the plywood sheets transported between the lower run of the cover band 16 and the upper run of the conveyor band 15. The aforementioned enless bands 15 and 16 are formed of coarse wire mesh or the like so that the hot air may pass therethrough onto the plywood sheets therebetween. Each of the ventilators 7 is driven by pole-changeable motors 10 selectively with two different rotational speeds. A separating wall 11 is provided above the heating means 9 to form a bypass 12, and a flap 13 is tiltably arranged at the right inlet end of the bypass 12 to open or close the latter to a variable degree, as will be described below. The top wall of the housing is provided with a chimney 14, in which a flap 14' is tiltably arranged. The position of the flap 14' may be controlled by an instrument measuring the degree of humidity in the drier to maintain the degree of humidity in the drier at an optimal value.

Figure 3:
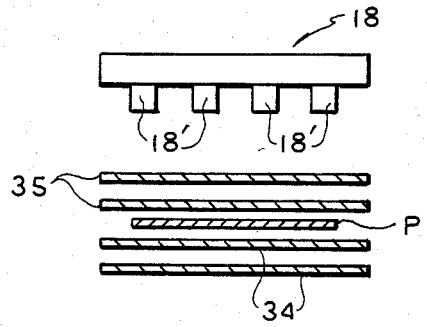
FIG. 3 is a front view of sensing means for sensing the width and sequence of the plywood sheets emanating from the plywood sheet cutting machine.

Upstream of the intermediate conveyor means 2, there is provided a sensing means 18 for sensing the width and the spacing between subsequent plywood sheets transported from the conveyors 34, 35 onto the intermediate conveyor 2. The sensing means 18 comprises, as best shown in FIG. 3, four transversely spaced measuring instruments 18', for instance electric eyes of known construction schematically illustrated in FIG. 3. Of course, the bands 34 and 35 have to be also constructed of wide wire mesh so that the light beams emanating from the elements 18' may pass therethrough and be interrupted only by the plywood sheets P transported between adjacent runs of the bands 34 and 35. A conductor 19 leads from the sensing means 18 to the inlet of control means 20 including a calculator. The control means 20 is connected by a conductor 51 to the drive motors 52 and 53 for the conveyor band 15 and the cover band 16, to control the speed of the conveyor band 15 and that of the cover band 16 in such a manner that the plywood sheets are transported on the conveyor band 15 at short distances from each other without overlapping. The calculator calculates also, in accordance with a predetermined, theoretically calculated or empirically established function, the optimal air volume stream corresponding to the respective conveyor speed. The control means 20 is also connected by conductors 54 to each of the drive motors 10 for the ventilators 7, whereby for simplicity only one of these conductors is shown in FIG. 1, so that only at a maximum required air stream, that is at high speed of the conveyor band 15, all of the motors 10 are driven at high rotational speed. However, if the conveyor band 15 is, due to reduced succession of cutting strokes of the cutting machine 1 or due to reduced width of the individual plywood sheets, operated at low speed, then some of the motors 10 are switched over to rotate at lower speed, and in the extreme case all of the motors 10 are switched to lower speed.

Two temperature sensors 21 and 22 are arranged in each of the consecutive drying sections in such a manner that the sensing means 22 senses the temperature of the hot air before it comes into contact with the plywood sheets transported through the respective section, whereas the sensing means 21 senses the temperature of the air after it has passed over the plywood sheet. The temperature sensing means 21 and 22 in each of the drying sections are respectively connected by conductors 23 and 24 to the control means 20, whereby for simplicity only the conductors 23 and 24 for one of the sections are shown in FIG. 1. The control means 20 converts the temperature sensed by the sensing means 21, 22 in a known manner into control signals which are transmitted over conductors 55 to servomotors 56 controlling the position of the flap 13 at each bypass 12, to open or close the latter in dependence upon the temperature sensed by the sensing means, to thereby control the volume of air passed respectively over the heating means or through the bypass to concomitantly control the temperature of the hot air blown over the plywood sheets as they are transported through the respective section of the drier. For simplicity, only one of the conductors 55 is shown in FIG. 1.

It will be understood that each of the elements described above, or two or more together, may also find a useful application in other types of continuous driers for plywood sheets differing from the types described above.

While the invention has been illustrated and described as embodied in a continuous drier for plywood sheets, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A continuous drier for plywood sheets adapted to be arranged in line with a cutting machine producing plywood sheets of various widths and in various successions, said drier comprising an elongated housing having an inlet end and being divided into a plurality of consecutive drying sections; conveyor means for transporting the plywood sheets from said inlet end through said consecutive sections of said elongated housing; drive means for driving said conveyor means with a variable speed; heating means, a ventilator for blowing air over said heating means and means for directing the thus produced hot air onto the plywood sheets and permitting transverse passage of the spent air over the plywood sheets in each of said sections; sensing means upstream of said inlet end of said housing for measuring the width and the spacing of said plywood sheets entering said housing; and control means in circuit with said sensing means and said drive means for regulating the speed of the conveyor means to assure a close succession of said plywood sheets on said conveyor means and for regulating the volume of the stream of hot air and/or the temperature of the latter in dependence upon the speed of said conveyor means.

2. A continuous drier as defined in claim 1, wherein each of said ventilators is driven by a variable-speed motor and wherein said control means varies the speed of each motor in dependence on the speed of said conveyor means.

3. A continuous drier as defined in claim 2, wherein the rotational speed of said drive motors for the ventilators is stepwise regulatable, and wherein depending on the regulated speed of said conveyor means some of said drive motors are adjusted to operate at high speed and the remainder of said drive motors are adjusted to operate at low speed.

4. A continuous drier as defined in claim 2, wherein said drive motors are constructed as continuously variable-speed motors.

5. A continuous drier as defined in claim 1, and including bypass means in each of said sections for passing part of the air stream produced by the respective ventilator past the respective heating means and a flap controlled by said control means for opening and closing said bypass means to a varying degree.

6. A continuous drier as defined in claim 1, wherein said sensing means comprise a plurality of transversely spaced sensing elements for measuring the width of the plywood sheets.

* * * * *